US008345905B2

(12) United States Patent
Takeda et al.

(10) Patent No.: US 8,345,905 B2
(45) Date of Patent: Jan. 1, 2013

(54) HEARING AID

(75) Inventors: Keiichi Takeda, Ehime (JP); Yosimasa Simogochi, Kanagawa (JP); Minoru Tada, Ehime (JP); Makoto Yagi, Ehime (JP); Fumihiro Asayama, Ehime (JP)

(73) Assignee: Panasonic Corporation, Osaka (JP)

( * ) Notice: Subject to any disclaimer, the term of this patent is extended or adjusted under 35 U.S.C. 154(b) by 293 days.

(21) Appl. No.: 12/933,193

(22) PCT Filed: Mar. 8, 2010

(86) PCT No.: PCT/JP2010/001615

§ 371 (c)(1),
(2), (4) Date: Sep. 17, 2010

(87) PCT Pub. No.: WO2010/103788

PCT Pub. Date: Sep. 16, 2010

(65) Prior Publication Data

US 2011/0013795 A1 Jan. 20, 2011

(30) Foreign Application Priority Data

Mar. 10, 2009 (JP) ..... 2009-056203

(51) Int. Cl.
*H04R 25/00* (2006.01)

(52) U.S. Cl. ..... 381/323; 381/324; 381/330

(58) Field of Classification Search ..... 381/314, 381/322, 323, 324, 327, 330, 381; 429/97, 429/98, 100

See application file for complete search history.

(56) References Cited

U.S. PATENT DOCUMENTS

| | | | | |
|---|---|---|---|---|
| 6,041,128 | A * | 3/2000 | Narisawa et al. | 381/322 |
| 7,068,804 | B2 * | 6/2006 | Batting | 381/330 |
| 7,450,732 | B2 * | 11/2008 | Kragelund | 381/323 |

FOREIGN PATENT DOCUMENTS

| | | |
|---|---|---|
| JP | 58-38943 | 9/1981 |
| JP | 61-1999 | 1/1986 |
| JP | 3-6075 | 2/1991 |
| JP | 5-76200 | 10/1993 |
| JP | 8-186898 | 7/1996 |
| JP | 9-215098 | 8/1997 |
| JP | 2974957 | 9/1999 |
| JP | 3070850 | 5/2000 |
| JP | 2004-227980 | 8/2004 |

* cited by examiner

*Primary Examiner* — Huyen D Le

(74) *Attorney, Agent, or Firm* — Wenderoth, Lind & Ponack, L.L.P.

(57) ABSTRACT

An arc-shaped waterproof wall is provided around a shaft to which a hearing aid main body case and a battery case are rotatably attached, and waterproof ribs are provided to the outer periphery of the installation face of the battery case and the hearing aid main body case, which improves the ability to prevent the penetration of moisture while also keep the cost low.

15 Claims, 8 Drawing Sheets

(a)

(b)

HEARING AID

TECHNICAL FIELD

The present invention relates to a hearing aid that supplements the hearing aid function by amplifying and outputting a collected sound source, and more particularly relates to a BTE (Behind-The-Ear) hearing aid. More precisely, the present invention relates to a hearing aid structure with which moisture is prevented from penetrating through gaps between the hearing aid main body case and the battery case.

BACKGROUND ART

In the past, since the main body of a BTE (Behind-The-Ear) hearing aid was exposed to the outside, the penetration of moisture, such as rain or perspiration, was a problem.

This was a particular problem with the battery case, and because it had a structure that was opened and closed during battery replacement, there was a gap between the hearing aid main body case and the battery case, making it extremely likely that water or perspiration would penetrate into the interior of the hearing aid.

In view of this, a hearing aid has been disclosed in the past in which the battery case is rotatably fitted to the hearing aid main body case, and a gasket is installed at the grounding face between the battery case opening and the opening at the lower end of the hearing aid main body case (see Patent Literature 1, for example). Consequently, the gasket is pressed when the battery case is closed, and this prevents the penetration of rain or perspiration into the battery case.

Also, there has been a disclosure in which the entire battery case is housed inside the hearing aid main body case, a groove is formed in the inner wall face of the battery case, and a hole is provided in the lower part of this groove, which allows any moisture that does penetrate to drain away (see Patent Literature 2, for example).

PRIOR ART PUBLICATIONS

Patent Literature

Patent Literature 1: Japanese Utility Model Publication H3-6075

Patent Literature 2: Japanese Patent No. 2,974,957

SUMMARY

Nevertheless, a problem with the method of Patent Literature 2, in which a groove or hole is provided for draining off any moisture that penetrates, is that as the size of the hearing aid main body case is reduced, there is less space available for the groove, and even though the groove is intended to drain off water, the effect of the surface tension of the water present in tiny gaps causes some water to remain inside the groove.

Also, when the waterproofing structure involving a gasket of Patent Literature 1 is applied to a structure in which the entire battery case is housed inside the hearing aid main body case as in Patent Literature 2, a gasket is provided to the side face of the battery case or to the inner wall face of the hearing aid main body case. Accordingly, since there is gasket rub every time the battery case is opened and closed, this creates a problem in terms of the durability of the gasket itself. Also, in the manufacturing process, attaching the gasket takes time and tends to drive up the cost.

The present invention solves the above problems encountered in the past, and provides a BTE (Behind-The-Ear) hearing aid which is inexpensive and with which moisture penetration is effectively prevented, even with a BTE hearing aid having a structure in which the entire battery case is housed inside the hearing aid main body case.

The hearing aid of the present invention comprises a hearing aid main body case, a hanger portion, a battery case, a rotary shaft, and a substantially arc-shaped wall portion. The hanger portion is provided to the end of the hearing aid main body case and is hooked to the upper part of the user's ear auricle. The battery case can be rotated with respect to the hearing aid main body case and housed inside the hearing aid main body case. The rotary shaft supports the battery case in a rotatable state with respect to the hearing aid main body case. The substantially arc-shaped wall portion is provided around the rotary shaft of the battery case so as to protrude from a side face substantially parallel to the rotation direction with respect to the hearing aid main body case, toward the inner wall face of the hearing aid main body case.

With the hearing aid of the present invention, it is preferable if the wall portion is formed in a concentric shape with respect to the rotary shaft.

With the hearing aid of the present invention, the wall portion is substantially arc-shaped, formed in a range of over 180 degrees around the rotary shaft.

With the hearing aid of the present invention, it is preferable if the rotary shaft is formed on a base portion having a substantially cylindrical shape, and the wall portion slides while in contact with the outer peripheral face of the base portion.

With the hearing aid of the present invention, it is preferable if the wall portion is formed in a concentric shape with respect to the rotary shaft, in a range of less than 360 degrees around the rotary shaft.

With the hearing aid of the present invention, it is preferable if the hearing aid main body case has a substantially arc-shaped groove in which the wall portion on the battery case side is fitted and slides.

With the hearing aid of the present invention, it is preferable if the groove has a first end that communicates with the outer surface of the hearing aid main body case and in which the wall portion slides, and a second end that blocks the inside of the hearing aid main body case.

It is also preferable if the hearing aid of the present invention further comprises a convex first rib provided along a side face of the battery case.

It is also preferable if the hearing aid of the present invention further comprises a convex second rib provided along the inner face of an opening that is opposite the side face of the battery case in the hearing aid main body case in a state in which the battery case is housed in the hearing aid main body case.

With the hearing aid of the present invention, it is preferable if the first rib has a height that is somewhat larger than the gap between the battery case and the hearing aid main body case.

With the hearing aid of the present invention, it is preferable if the second rib has a height that is somewhat larger than the gap between the battery case and the hearing aid main body case.

It is also preferable if the hearing aid of the present invention further comprises a convex first rib provided along a side face of the battery case, and a convex second rib provided along the inner face of an opening that is opposite the side face of the battery case in the hearing aid main body case in a state in which the battery case is housed in the hearing aid main body case, wherein, in a state in which the battery case is housed in the hearing aid main body case, the first rib and the second rib are disposed at nearby positions where they do not interfere with each other.

With the hearing aid of the present invention, it is preferable if the relation between the height R1 of the first rib and the size H of the gap between the hearing aid main body case and the battery case satisfies the relation $H/2 \leqq R1 < H$.

With the hearing aid of the present invention, it is preferable if the relation between the height R2 of the second rib and the size H of the gap between the hearing aid main body case and the battery case satisfies the relation $H/2 \leqq R2 < H$.

With the hearing aid of the present invention, it is preferable if the gap H is set to be no more than 0.05 mm.

ADVANTAGEOUS EFFECTS

With the hearing aid of the present invention, the penetration of moisture can be prevented at low cost even with a hearing aid structure in which the entire battery case is housed in the hearing aid main body case.

DESCRIPTION OF EMBODIMENTS

A BTE (Behind-The-Ear) hearing aid comprises a microphone, a speech processor that processes a speech signal inputted from the microphone, an amplifier that amplifies the speech signal, a receiver that transmits the amplified speech signal as a sound vibration to the ear canal of the wearer, and a battery that drives the hearing aid, all housed in a BTE (behind the ear) configuration disposed behind the ear.

Another BTE hearing aid that is on the market is called an RIC (receiver in the canal), with which the receiver is electrically connected to the outside of the BTE, and this is disposed directly in the ear canal.

The hearing aid of the present invention comprises a structure that prevents the penetration of moisture into the part that houses the battery that is installed in the BTE hearing aid.

Embodiment 1

Figure 1:
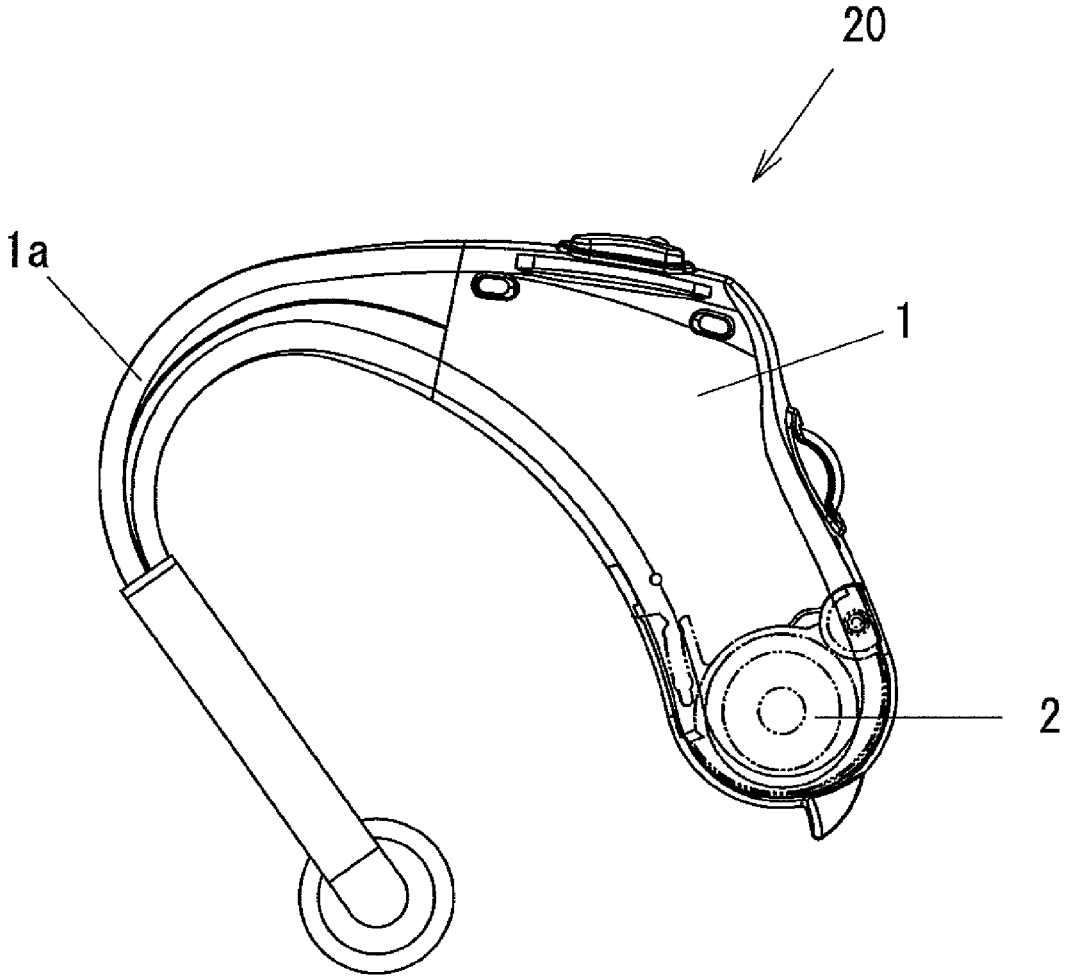
FIG. 1 is an overall view of the BTE hearing aid pertaining to Embodiment 1 of the present invention.

FIG. 1 is an overall view of the BTE hearing aid 20 pertaining to Embodiment 1 of the present invention.

The hearing aid 20 of this embodiment mainly comprises, as its outer housing, a hearing aid main body case 1 and a battery case 2. Although not depicted, the hearing aid main body case 1 includes electrical circuits for a microphone, signal processor, amplifier, receiver, etc. A hanger portion 1*a* that is hooked onto the upper part of the ear auricle of the wearer during use is linked to the upper end of the hearing aid main body case 1. A battery that supplies electricity to the electrical circuits is housed in the battery case 2.

Figure 2:
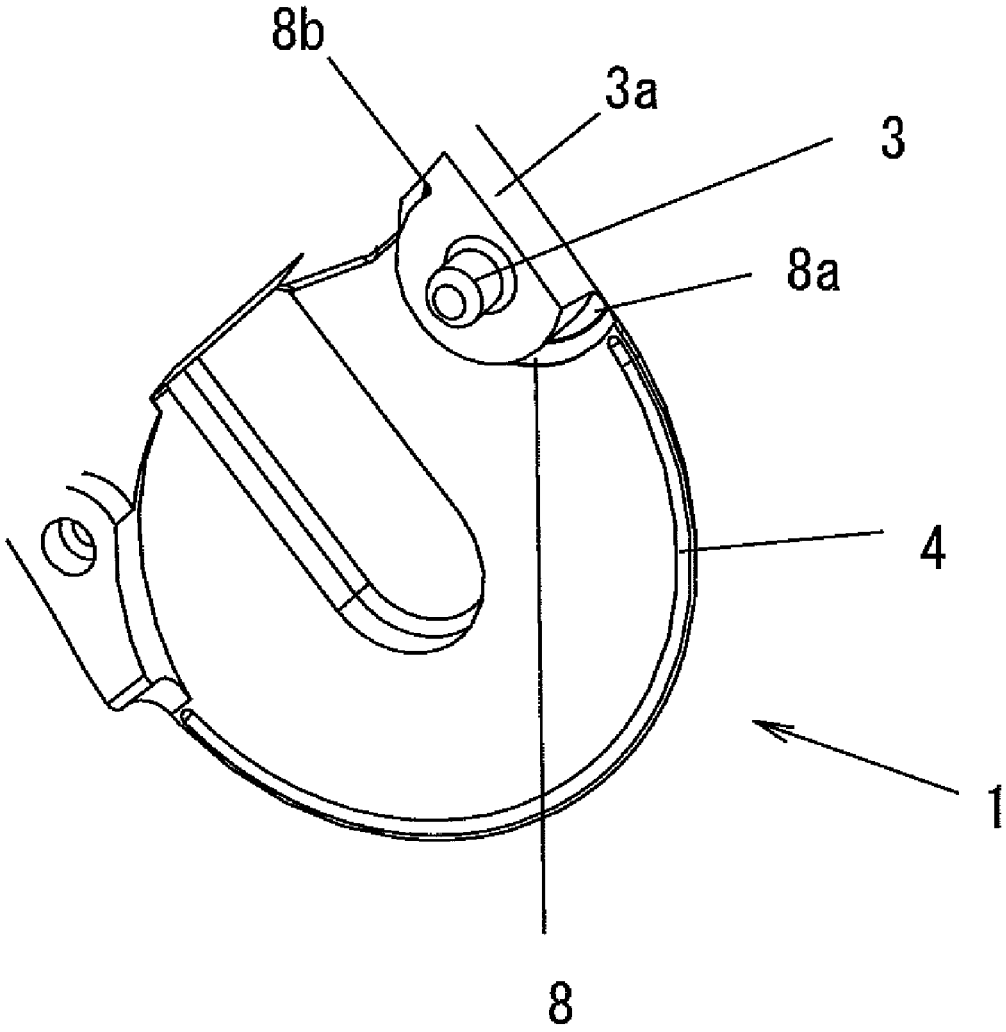
FIG. 2 is a detail perspective view of the configuration of the battery case housing portion of the hearing aid main body case of the hearing aid in FIG. 1.

FIG. 2 is a detail perspective view of the configuration of the battery case housing portion of the hearing aid main body case 1.

As shown in FIG. 2, the hearing aid main body case 1 has a convex portion (rotary shaft) 3 that rotatably supports the battery case 2, and a rib (second rib) 4 for narrowing the gap produced between the hearing aid main body case 1 and the battery case 2.

As shown in FIG. 2, the convex portion 3 is disposed on the inside of the hearing aid main body case 1, is formed so as to protrude inward from the interior surface thereof, and has a substantially cylindrical shape. Also, the convex portion 3 is formed on a substantially cylindrical base portion 3*a*. The base portion 3*a* has a shape in which part of the cylindrical shape is cut off, and a groove 8 is formed in the outer peripheral part thereof.

A wall portion 6 (see FIG. 3*a*) of the battery case 2 (discussed below) is fitted into the groove 8 and slides in this state. Also, as shown in FIG. 2, the groove 8 has a first end 8*a*, which serves as an open end that communicates with the outer peripheral surface of the hearing aid main body case 1, at one end going around the outer periphery of the substantially cylindrical base portion 3*a*. The groove 8 also has a second end 8*b*, which serves as a closed end that does not communicate with the outer peripheral surface of the hearing aid main body case 1, at the end on the interior side of the hearing aid main body case 1 going around the outer periphery of the substantially cylindrical base portion 3*a*.

Consequently, the groove 8 is open only at one end of the approximate arc shape (the first end 8*a*), and the second end 8*b* is a closed end within the hearing aid main body case 1, so this results in a structure with which it is more difficult for moisture to penetrate from the outer peripheral surface of the hearing aid 20.

In order to fill in the gap between the hearing aid main body case 1 and the battery case 2, the rib 4 protrudes toward the battery case 2 side from the interior space side of the hearing aid main body case 1 in which the battery case 2 is housed. Also, as shown in FIG. 2, the rib 4 is disposed substantially in an arc shape so as to be disposed along the outer end under the battery case 2 in a state in which the battery case 2 is housed inside the hearing aid main body case 1.

Only one convex portion 3, one rib 4, etc., are shown in FIG. 2, but actually the other halves of these pairs are provided on the opposite side of the space in which the battery case 2 is housed in the hearing aid 20.

Figure 3:
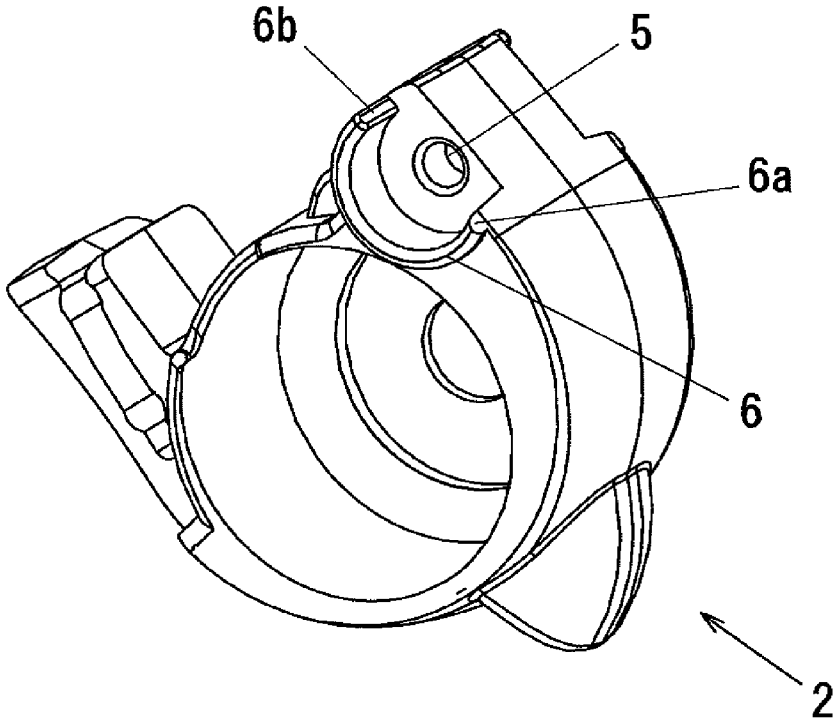
FIG. 3*a* is a perspective view of the configuration of the battery case of the hearing aid in FIG. 1.
FIG. 3*b* is a plan view of the configuration of the wall portion of the battery case in FIG. 3*a;*
Figure 3:
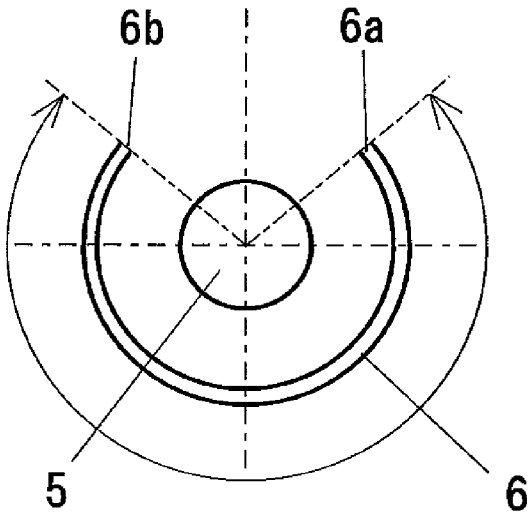

FIG. 3*a* is a perspective view of the configuration of the battery case 2.

As shown in FIG. 3*a*, the battery case 2 has a concave portion 5 that mates with the convex portion 3 of the hearing aid main body case 1, and the wall portion 6 provided in the form of an arc, which is concentric with the convex portion 3 serving as a rotary shaft, around this concave portion 5.

The concave portion 5 is a cylindrical recess that mates with the substantially cylindrical convex portion 3, and has a diameter that is somewhat larger than the diameter of the convex portion 3. Consequently, the convex portion 3 on the hearing aid main body case 1 side functions as a rotary shaft, allowing the battery case 2 to rotate with respect to the hearing aid main body case 1.

As shown in FIG. 3*a*, the wall portion 6 is formed concentrically with the cylindrical concave portion 5, and forms a wall face that protrudes from a side face substantially parallel to the rotation direction in the battery case 2. Also, when the battery case 2 is rotated with respect to the hearing aid main body case 1, the wall portion 6 slides along the inner peripheral face of the substantially arc-shaped wall in a state of being in contact with the outer peripheral face of the base portion 3*a* on the hearing aid main body case 1 side. Consequently, by being combined with the wall portion 6, the base portion 3*a* can also function as a rotary shaft of the battery case 2 along with the convex portion 3. Furthermore, as shown in FIGS. 3*a* and 3*b*, the wall portion 6 has a first end 6*a* disposed at the outer surface of the hearing aid main body case 1, and a second end 6*b* located on the interior space side of the hearing aid main body case 1.

In a closed state in which the battery case 2 is housed in the hearing aid main body case 1, the first end 6*a* is located near the first end 8*a* of the groove 8 on the hearing aid main body case 1. Meanwhile, the second end 6*b* is located near the second end 8*b* of the groove 8. As the battery case 2 is rotated with respect to the hearing aid main body case 1 and moves toward an open state, the first end 6*a* moves along with the rotation of the battery case 2 to outside the hearing aid main body case 1. The second end 6*b*, meanwhile, moves from the interior space of the hearing aid main body case 1 to near the first end 8*a* of the groove 8 located on the outer surface.

Furthermore, in a closed state in which the battery case 2 is housed inside the hearing aid main body case 1, the second end 6*b* of the wall portion 6 may be in contact with the second end 8*b* of the groove 8 on the hearing aid main body case 1 side. In this case, the second end 8*b* can function as a stopper that limits the stopping point of the rotation of the battery case 2.

As shown in FIG. 3*b*, the wall portion 6 continuously forms an arc-shaped wall face within a range of greater than 180 degrees and less than 360 degrees around the concave portion 5 in plan view (the side face view of the hearing aid 20 in a mounted state). Consequently, compared to a configuration in which the wall portion 6 is only formed in a range of no more than 180 degrees, the sliding distance can be increased between the outer peripheral face of the base portion 3*a* and the inner peripheral face of the wall portion 6 when the battery case 2 is opened and closed. Thus, operation can be stabilized in the opening and closing of the battery case 2. Accordingly, this prevents the gap from becoming wider due to wear, etc., caused by looseness between the hearing aid main body case 1 and the battery case 2 when the battery case 2 is opened and closed. As a result, the penetration of moisture into the interior of the hearing aid 20 can be suppressed, and even if some moisture should penetrate, the wall portion 6 makes it less likely that the penetration will be all the way into the interior.

Also, since the wall face of the wall portion 6 is not formed over a range of 360 degrees around the concave portion 5, it includes a part that is cut out. Consequently, this cut-out portion can be utilized to dispose the concave portion 5 that mates with the convex portion 3 at a location near the outer surface. As a result, the hearing aid 20 can be more compact than with a configuration in which the wall is formed over a range of 360 degrees.

Figure 4:
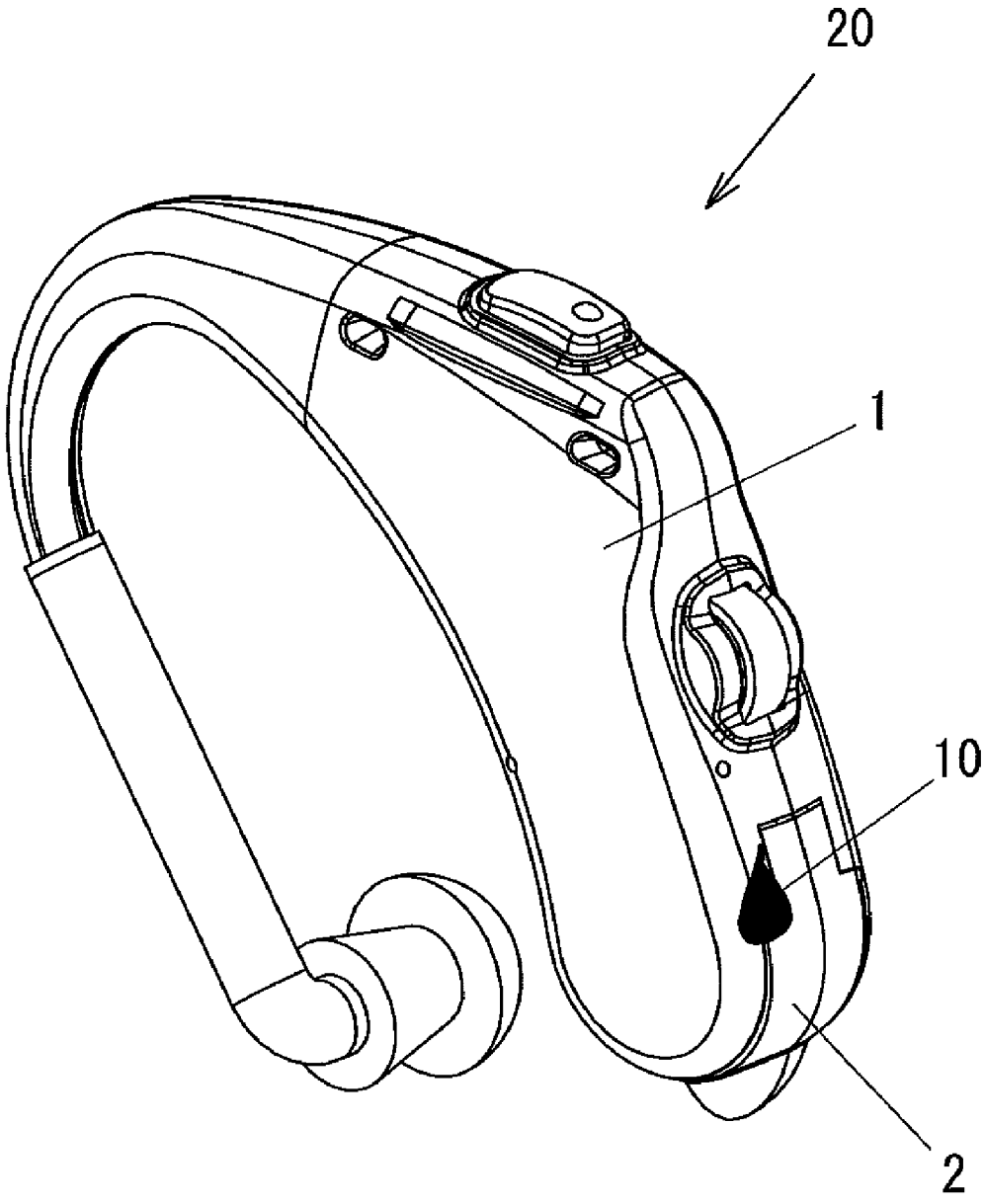
FIG. 4 is a perspective view of a state in which a drop of water has adhered to the hearing aid of FIG. 1.

FIG. 4 is a perspective view of a state in which a drop of water has adhered to the outer surface of the hearing aid 20.

The water drop 10 adheres around the rotary shaft to which the hearing aid main body case 1 and the battery case 2 are fitted. This position is the upper face when the hearing aid 20 is put on, so it is where rain, perspiration, and other such moisture tends to adhere.

Also, if small vibrations are imparted to the hearing aid 20 in this state when the wearer walks, etc., the moisture gradually works its way in through the gap.

Figure 5:
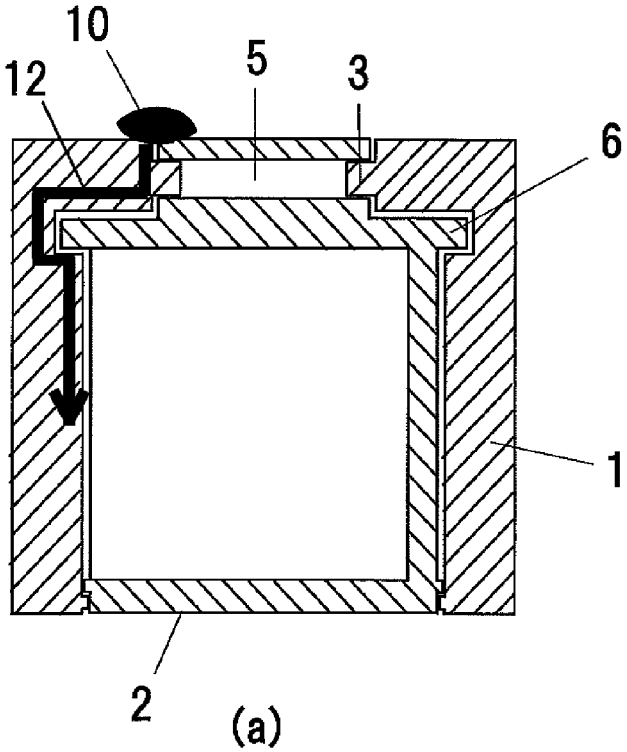
FIGS. 5*a* and 5*b* are a schematic diagram of the path by which the water drop penetrates into the hearing aid of FIG. 1, and a schematic diagram of a comparative example thereof.
Figure 5:
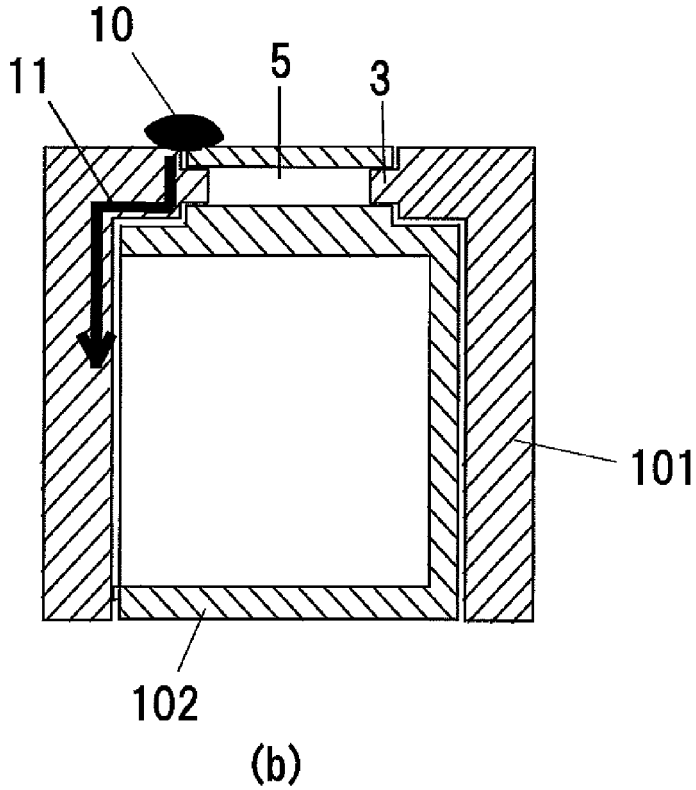

FIGS. 5*a* and 5*b* are cross-sectional views illustrating the state in which the battery case has been housed in the hearing aid main body case, and are diagrams of the path by which the water drop penetrates. More specifically, FIG. 5*a* is a diagram of the hearing aid 20 in this embodiment, and FIG. 5*b* is a diagram of a comparative example thereof.

First, as shown in FIG. 5*b*, with the constitution of a comparative example which lacks the wall portion 6 of the hearing aid 20 of this embodiment, if the water drop 10 penetrates to the end of the wall portion of a hearing aid main body case 101, the water ends up working its way along a penetration path 11 into the interior of a battery case 102.

In contrast, with the hearing aid 20 of this embodiment, as shown in FIG. 5*a*, the wall portion 6 is provided to part of the wall portion of the battery case 2. The water drop 10 that has penetrated to the end of the wall portion of the battery case 2 moves along the penetration path 12, and downward in the drawing along the wall portion 6, after which it turns 90 degrees and proceeds to the right side in the drawing. Accordingly, compared to the comparative example shown in FIG. 5*b*, the penetration path of the water drop 10 is more complex, the distance traveled is longer, and there is greater resistance in the movement of the water drop 10. As a result, penetration of the water drop 10 into the interior of the battery case 2 of the hearing aid 20 can be effectively prevented.

Also, where the water drop 10 penetrates into the hearing aid 20 is not just around the convex portion 3 serving as the rotary shaft of the battery case 2, but all the way around the battery case 2.

Because of this, to prevent the penetration of the water drop, it is desirable for the hearing aid main body case 1 and the battery case 2 to be completely sealed so that the gap between them is completely filled in.

Figure 6:
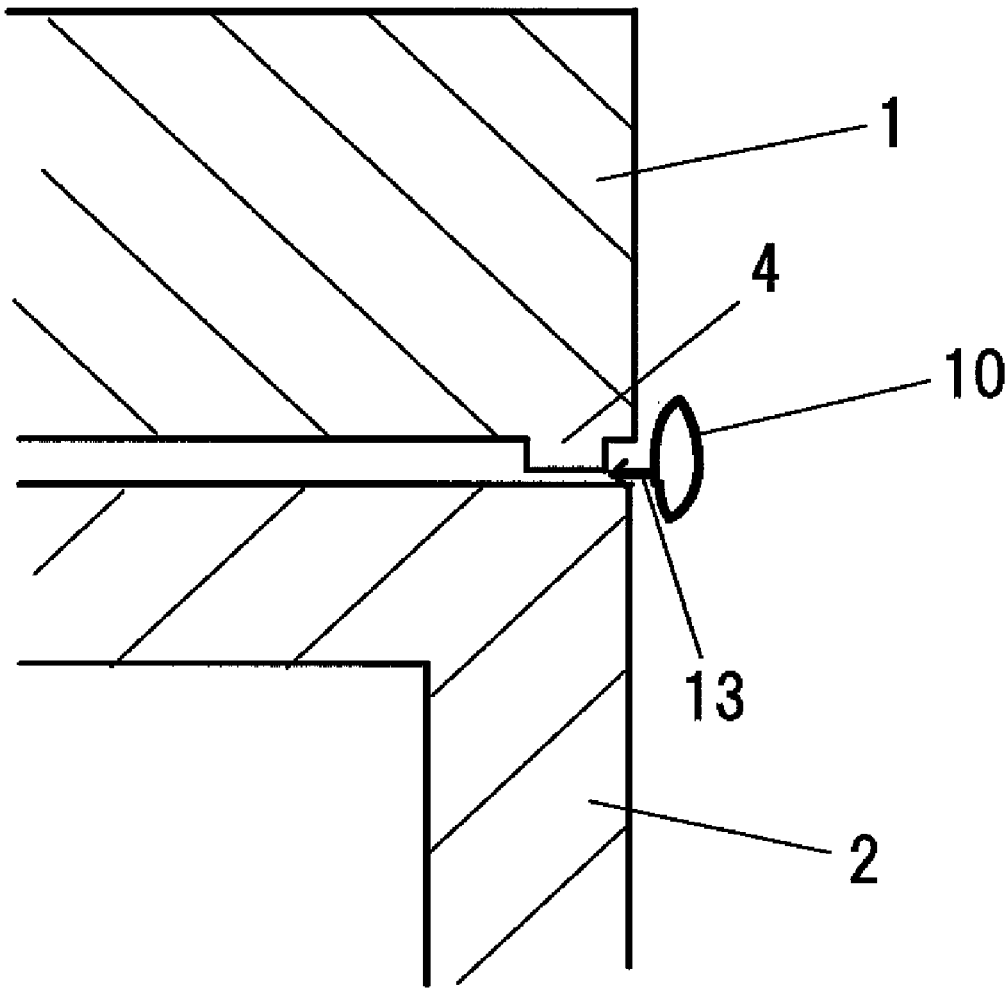
FIG. 6 is a partial cross-sectional view illustrating a state in which a drop of water has adhered to the hearing aid pertaining to another embodiment (Embodiment 2) of the present invention.

In view of this, as shown in FIG. 6, by providing the rib 4 along the outer periphery of the inner face of the hearing aid main body case 1, the gap is partially narrowed between the side face of the battery case 2 and the wall face inside the part of the hearing aid main body case 1 that houses the battery case 2. Here, having the rib height be slightly lower than the height of the gap does help to prevent the penetration path 13 of the water drop 10, but it is preferable if the rib 4 is slightly taller than the size of the gap, that is, tall enough to create an interference-fit structure when the battery case 2 is housed inside the hearing aid main body case 1.

More specifically, with a gap of 0.05 mm, the height of the rib 4 is set to 0.06 mm. This further enhances the effect of preventing moisture penetration. The above-mentioned interference-fit structure refers to a structure in which there is always interference when two mating parts are put together.

FIG. 6 is a diagram of the water penetration path 13 in the case of an interference-fit structure.

Here, in a state in which the battery case 2 is housed in the hearing aid main body case 1, as shown in FIG. 6, basically the result is a state in which the rib 4 is press-fitted to the side face of the battery case 2. Accordingly, this is extremely effective at preventing the penetration of the water drop 10 into the battery case 2.

Embodiment 2

In Embodiment 2, we will describe a hearing aid comprising a rib structure that differs from that of the hearing aid in Embodiment 1 above.

Figure 7:
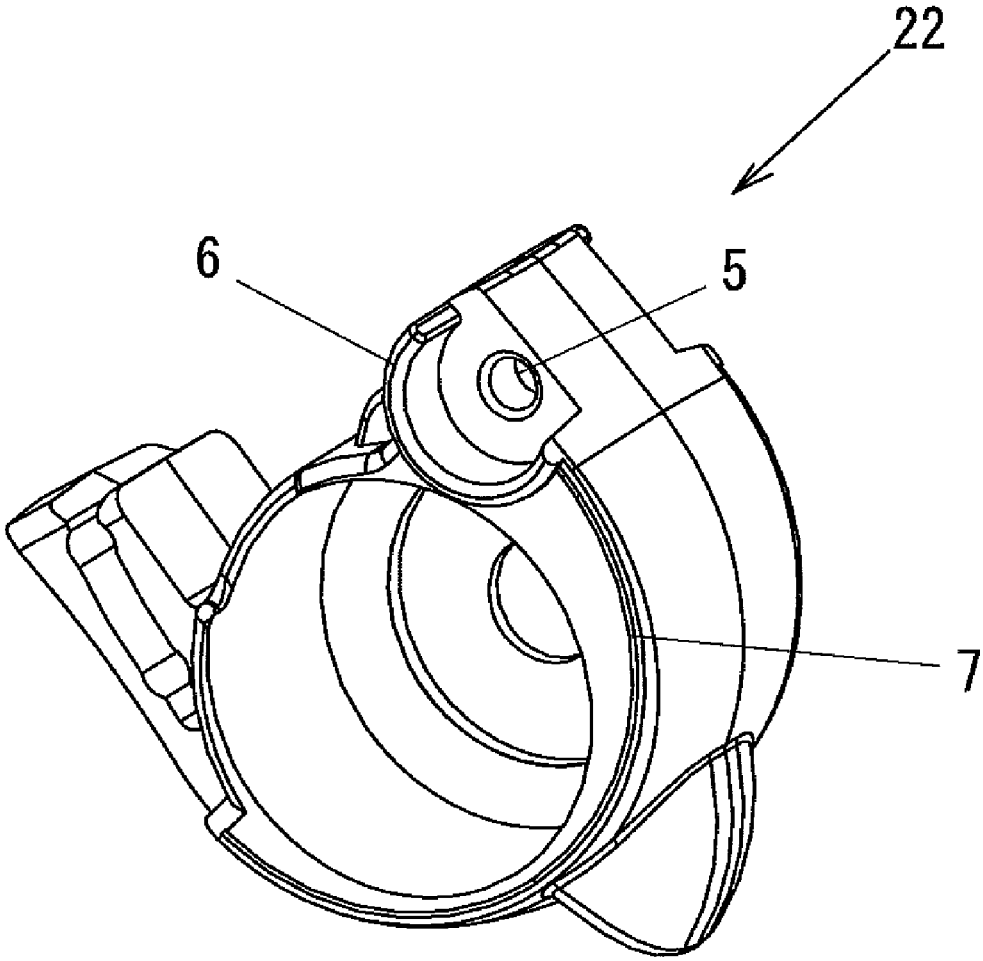
FIG. 7 is a perspective view of the configuration of the battery case of the hearing aid in FIG. 6.

In addition to the rib 4 of the hearing aid main body case 1 described in Embodiment 1 above, in this constitution there is also a rib 7 (first rib) on the side face of a battery case 22, as shown in FIG. 7.

The rib 4 and the rib 7 are formed so as not to interfere with each other in a state in which the battery case 22 is housed. When the battery case 22 is housed in the hearing aid main body case 1, the positional relation between the rib 4 and the rib 7 is as shown in FIG. 8, for example.

Figure 8:
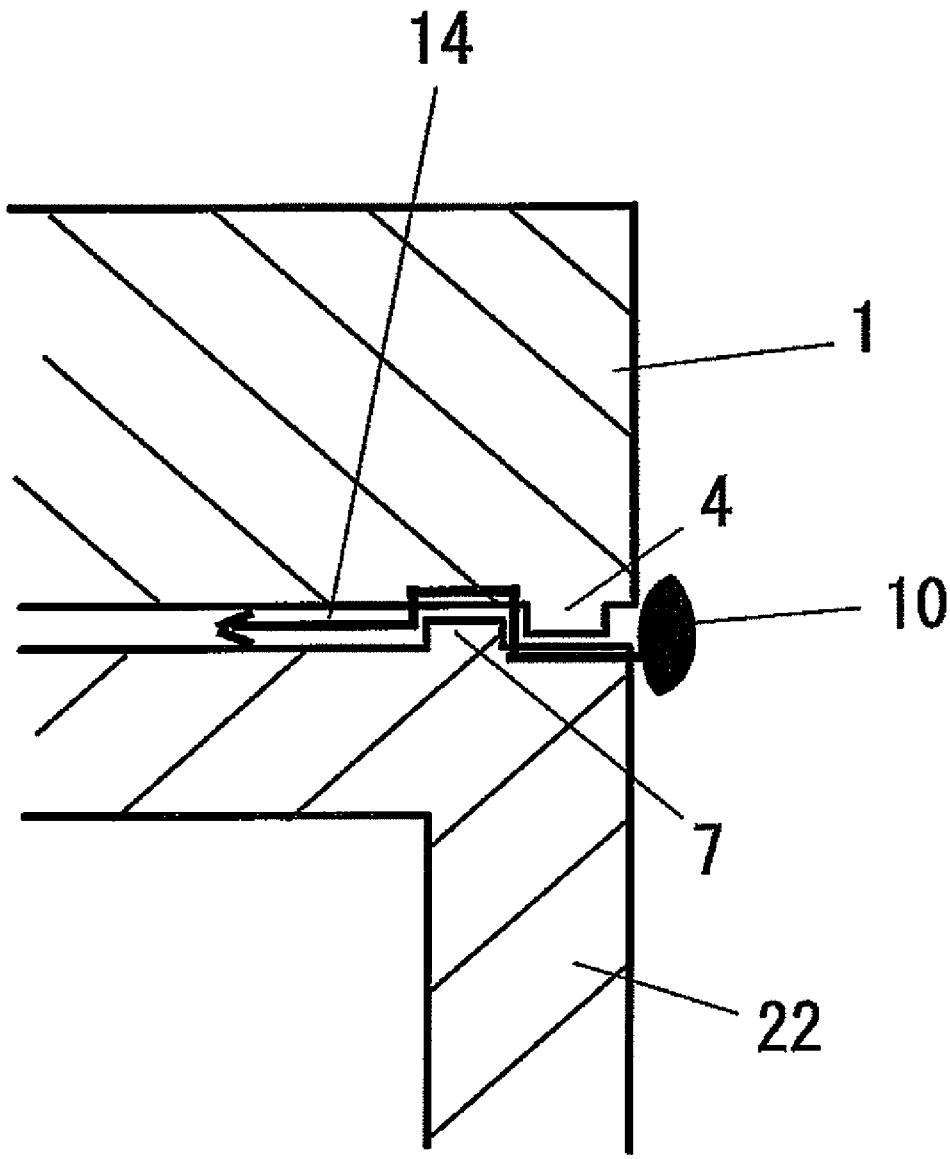
FIG. 8 is a schematic diagram of the path by which a water drop penetrates into the hearing aid of FIG. 6.

Consequently, as shown in FIG. 8, the water drop 10 must follow a snaking penetration path 14, making it more difficult to penetration into the battery case 22. Furthermore, the water drop 10 adhering to the gap between the hearing aid main body case 1 and the battery case 22 tends to flow along the ribs 4 and 7 to the outside of the hearing aid and fall off. Accordingly, the effect of preventing the penetration of the water drop 10 into the battery case 22 can be further enhanced.

Also, the height of the rib 4 and the rib 7 is preferably set so that the ribs rub somewhat when the battery case 22 is opened and closed.

For example, when the gap between the hearing aid main body case 1 and the battery case 22 is 0.05 mm, the height R1 of the rib 4 is preferably set to at least 0.025 mm and the height R2 of the rib 7 to at least 0.025 mm, and more preferably, the heights R1 and R2 are each set to 0.03 mm so that the distal end portions of the ribs 4 and 7 will overlap.

In other words, the relation between the heights R1 and R2 and the gap H between the hearing aid main body case 1 and the battery case 22 is set as follows, with the heights of the ribs 4 and 7 set within these ranges.

$$H/2 \leqq R1 < H$$

$$H/2 \leqq R2 < H$$

Consequently, this avoids the problem of the ribs 4 and 7 interfering with each other in a state in which the battery case 22 is housed in the hearing aid main body case 1, or when the battery case 22 is opened or closed with respect to the hearing aid main body case 1.

Other Embodiments

Embodiments of the present invention were described above, but the present invention is not limited to these, and various modifications are possible without departing from the gist of the invention.

(A)

In the above embodiments, an example was described in which the groove 8 was provided on the hearing aid main body case 1 side and the wall portion 6 on the battery case 2 side. However, the present invention is not limited to this.

For instance, the reverse configuration may be employed, in which the wall portion is provided on the hearing aid main body case side, and the groove on the battery case side. Here again, the same effect as that obtained in the above embodiments can be obtained by sliding the wall portion in a state of its being fitted into the groove.

(B)

In the above embodiments, an example was described in which the rib 4 was disposed on the hearing aid main body case 1 side. However, the present invention is not limited to this.

For instance, the reverse configuration may be employed, in which a rib is disposed on the side face of the battery case 2. Here again, the same effect as that obtained in the above embodiments can be obtained.

(C)

In the above embodiments, an example was described in which the convex portion 3 was provided on the hearing aid main body case 1 side, and the concave portion 5 on the battery case 2 side. However, the present invention is not limited to this.

For instance, the configuration may be such that the concave portion is provided on the hearing aid main body case 1 side, and the convex portion on the battery case 2 side.

INDUSTRIAL APPLICABILITY

The BTE hearing aid pertaining to the present invention better prevents the penetration of water from the battery case, which is useful in terms of increasing the quality of the hearing aid.

REFERENCE SIGNS LIST

1 hearing aid main body case
1*a* hanger portion
2 battery case
3 convex portion (rotary shaft)
3*a* base portion
4 rib (second rib)
5 concave portion
6 wall portion
6*a* first end
6*b* second end
7 rib (first rib)
8 groove
8*a* first end
8*b* second end
10 water drop
11 penetration path
12 penetration path
13 penetration path
14 penetration path
20 hearing aid
22 battery case

The invention claimed is:

1. A hearing aid, comprising:

a hearing aid main body case;

a hanger portion that is provided to the end of the hearing aid main body case and is hooked to the upper part of the user's ear auricle;

a battery case that can be rotated with respect to the hearing aid main body case and housed inside the hearing aid main body case;

a rotary shaft that supports the battery case in a rotatable state with respect to the hearing aid main body case; and a substantially arc-shaped wall portion provided around the rotary shaft of the battery case so as to protrude from a side face substantially parallel to the rotation direction with respect to the hearing aid main body case, toward the inner wall face of the hearing aid main body case.

2. The hearing aid according to claim 1, wherein the wall portion is formed in a concentric shape with respect to the rotary shaft.

3. The hearing aid according to claim 1, wherein the wall portion is substantially arc-shaped, formed in a range of over 180 degrees around the rotary shaft.

4. The hearing aid according to claim 1, wherein the rotary shaft is formed on a base portion having a substantially cylindrical shape, and the wall portion slides while in contact with the outer peripheral face of the base portion.

5. The hearing aid according to claim 1, wherein the wall portion is formed in a concentric shape with respect to the rotary shaft, in a range of less than 360 degrees around the rotary shaft.

6. The hearing aid according to claim 1, wherein the hearing aid main body case has a substantially arc-shaped groove in which the wall portion on the battery case side is fitted and slides.

7. The hearing aid according to claim 6, wherein the groove has a first end that communicates with the outer surface of the hearing aid main body case and in which the wall portion slides, and a second end that blocks the inside of the hearing aid main body case.

8. The hearing aid according to claim 1, further comprising a convex first rib provided along a side face of the battery case.

9. The hearing aid according to claim 8, wherein the first rib has a height that is somewhat larger than the gap between the battery case and the hearing aid main body case.

10. The hearing aid according to claim 1, further comprising a convex second rib provided along the inner face of an opening that is opposite the side face of the battery case in the hearing aid main body case in a state in which the battery case is housed in the hearing aid main body case.

11. The hearing aid according to claim 10, wherein the second rib has a height that is somewhat larger than the gap between the battery case and the hearing aid main body case.

12. The hearing aid according to claim 1, further comprising:

a convex first rib provided along a side face of the battery case; and a convex second rib provided along the inner face of an opening that is opposite the side face of the battery case in the hearing aid main body case in a state in which the battery case is housed in the hearing aid main body case, wherein, in a state in which the battery case is housed in the hearing aid main body case, the first rib and the second rib are disposed at nearby positions where they do not interfere with each other.

13. The hearing aid according to claim 12, wherein the relation between the height R1 of the first rib and the size H of the gap between the hearing aid main body case and the battery case satisfies the relation $H/2 \leqq R1 < H$.

14. The hearing aid according to claim 13, wherein the gap H is set to be no more than 0.05 mm.

15. The hearing aid according to claim 12, wherein the relation between the height R2 of the second rib and the size H of the gap between the hearing aid main body case and the battery case satisfies the relation $H/2 \leqq R2 < H$.

* * * * *